US007013492B2

(12) United States Patent
Hugh et al.

(10) Patent No.: US 7,013,492 B2
(45) Date of Patent: Mar. 21, 2006

(54) DEVICE FOR FIXING EARPHONES AND/OR MINI-MICROPHONES

(75) Inventors: Errolson Hugh, Munich (DE); Michaela Sachenbacher, Munich (DE)

(73) Assignee: Acronym GmbH, Munich (DE)

( * ) Notice: Subject to any disclaimer, the term of this patent is extended or adjusted under 35 U.S.C. 154(b) by 225 days.

(21) Appl. No.: 10/204,513

(22) PCT Filed: Feb. 14, 2001

(86) PCT No.: PCT/DE01/00555

§ 371 (c)(1),
(2), (4) Date: Aug. 21, 2002

(87) PCT Pub. No.: WO01/63966

PCT Pub. Date: Aug. 30, 2001

(65) Prior Publication Data

US 2003/0019015 A1 Jan. 30, 2003

(30) Foreign Application Priority Data

Feb. 21, 2000 (DE) ..... 100 07 845

(51) Int. Cl.
*A41D 27/00* (2006.01)

(52) U.S. Cl. ..... 2/243.1; 2/69; 381/364

(58) Field of Classification Search ..... 2/69, 2/209, 208, 209.13, 336, DIG. 11, 243.1, 2/115, 102, 108, 94, 1, 265, 244, 249, 250; 381/322, 124, 1, 361, 364, 365, 366, 367, 381/171, 386, 87, 91, 188, 169; 24/303, 1, 24/3.1; 455/575.6, 569.1, 344

See application file for complete search history.

(56) References Cited

U.S. PATENT DOCUMENTS 2,299,558 A * 10/1942 Mundel et al. ..... 381/322
2,616,985 A * 11/1952 Levy ..... 381/322
2,760,744 A * 8/1956 Watrous ..... 248/123.2

(Continued)

FOREIGN PATENT DOCUMENTS

| | | | |
|---|---|---|---|
| DE | 3632125 | | 3/1988 |
| DE | 19700670 | | 7/1998 |
| EP | 10136482 | * | 5/1998 |
| EP | 2000189227 | * | 7/2000 |
| GB | 2186625 | | 8/1987 |

OTHER PUBLICATIONS

Patent Abstracts of Japan vol. 1995, No. 08; Sep. 9, 1995 –&JP 07131877 A (Matsushita Electric Ind Co Ltd), May 19, 1995.
Patent Abstracts of Japan Publ. No. 09154196; Appl. No. 07313360 Date of Filing Nov. 1995.
Patent Abstracts of Japan Publ. No. 10051877; App. No. 08216114; Date of Filing: Jul. 1996.
Patent Abstracts of Japan Publ. No. 0913991; App. No. 07332452; Date of Filing: Nov. 1995.

*Primary Examiner*—A. Vanatta
(74) *Attorney, Agent, or Firm*—Collard & Roe, P.C.

(57) ABSTRACT

A device for fixing ear-phones and/or mini-microphones, especially to items of clothing or equipment. The aim of the invention is to develop a secure, easy to handle, precisely positionable, economical, optional means of fixing even earphones and/or mini-microphones whose structural shapes are years old. The fixing means should neither increase the transport weight nor the construction volume of the earphones and/or mini-microphones, should be usable even in an adapted state in a appropriate position on the item of clothing and/or equipment, and should guarantee (with the exception of special structural shapes) overload protection with an emergency triggering function when there is a strong pull on the earphone and/or microphone cable. To this end, a permanent magnet, a magnet system or an adhesive system is provided at the designated fixing point for the earphones and/or mini-microphones outside or inside of the particular item of clothing and/or equipment.

16 Claims, 7 Drawing Sheets

U.S. PATENT DOCUMENTS 3,668,321 A * 6/1972 Lang ..... 381/124
4,319,097 A * 3/1982 Liautaud ..... 381/365
4,410,772 A 10/1983 Sato
4,429,194 A * 1/1984 Kamon et al. ..... 381/380
4,669,129 A * 6/1987 Chance ..... 2/209
4,827,525 A * 5/1989 Hotvet et al. ..... 381/60
4,858,248 A * 8/1989 Goldsmith et al. ..... 2/209.13
5,096,284 A * 3/1992 NakaMats ..... 351/123
5,125,134 A * 6/1992 Morita ..... 24/303
5,163,093 A * 11/1992 Frielingsdorf et al. ..... 381/151
5,410,746 A * 4/1995 Gelber ..... 455/344
5,551,089 A * 9/1996 Whidden ..... 2/209
5,677,948 A 10/1997 Meister
5,737,430 A * 4/1998 Widrow ..... 381/313
5,752,632 A * 5/1998 Sanderson et al. ..... 224/182
5,793,875 A * 8/1998 Lehr et al. ..... 381/313
5,992,807 A * 11/1999 Tarulli ..... 248/206.5
6,121,528 A * 9/2000 May ..... 84/411 R
6,438,245 B1 * 8/2002 Taenzer et al. ..... 381/330
6,507,280 B1 * 1/2003 Tabata et al. ..... 340/573.1
6,721,579 B1 * 4/2004 Liu ..... 455/569.1
2001/0012373 A1 * 8/2001 Graumann ..... 381/364
2002/0065115 A1 * 5/2002 Lindholm ..... 455/568
2002/0080985 A1 * 6/2002 Ho ..... 381/334

* cited by examiner

DEVICE FOR FIXING EARPHONES AND/OR MINI-MICROPHONES

CROSS REFERENCE TO RELATED APPLICATIONS

Applicants claim priority under 35 U.S.C. §119 of GERMAN Application No. 100 07 845.1 filed on 21 Feb. 2000. Applicants also claim priority under 35 U.S.C. §365 of PCT/DE01/00555 filed on 14 Feb. 2001. The international application under PCT article 21(2) was not published in English.

The invention relates to a device for fixing earphones and/or mini-microphones especially on items of clothing or equipment.

The use of headphones or earphones, or earphone-and-mini-microphone combinations is mostly required in conjunction with the use of mobile telephones, two-way radiotelephones, walkman and discman devices, dictating machines and similar items of equipment.

The earphones are in this connection already combined to some extent with bow-like headphones and mini-microphones in the form of headsets.

In the field of leisure applications, however, headsets equipped with bow-shaped headphones are hardly used because of their relatively large transport volume. Mini-microphones, which have a very small transport volume, and additional earphones are given preference for that reason in the area of leisure applications in most cases, the latter to some extent also with a mini-microphone integrated on the feed cable.

Now, all kinds of different devices suspended on the ear for fixing earphones have become known in the prior art, for example of the type described earlier in DE 197 00 670 C1. Such devices are particularly intended to prevent earphones from being pulled from the ear if the earphone feed cable is unintentionally subjected to tensile stress.

In other embodiments, the earphones are accommodated in pockets of a headband that can be sealed, as it is described, for example in DE 3632 125 A1. With such variations of securing the equipment, it is always necessary to transport other accessories in addition to the earphones.

The situation is comparable as well with the rolls of cable described in the prior art for earphone cables, for example in JP 9154196 or JP 10051877. In addition to the increased transport and construction volumes necessarily conditioned by the rolls of cable material, winding up the cable again on the cable reel after the earphones have been removed from the ears is always connected with additional expenditure as well.

So as to avoid subjecting the earphone feed cable to any unintended tensile stress and to thus prevent the earphone from being pulled from the ear, the earphone cables connected with the respective basic communication device are in most cases mounted under the garment especially in connection with activities for leisure purposes.

An important drawback of this very frequently used variation is made particularly obvious if the earphones have to be removed for a short time during shopping or while engaging in a conversation.

In such cases, the earphones are freely suspended on their cables, dangling on top of the garments.

Such freely suspended earphones can then easily get jammed or hooked up or they may even be torn off when walking passed objects or other people.

Such unintentional free suspension of the earphones is to be avoided, for example in connection with the earphones comprising an integrated clip, which are described in JP 139991.

With such an embodiment, the earphones, after they have been used, can be pinned, for example to any shirt, blouse or other piece of clothing or object of equipment by the "crocodile" clip that is connected with the earphones in a fixed manner.

An important drawback of this type of fastening device, however, consists in that the crocodile clip, which is connected in a rigid manner with each of the earphones, noticeably increases the construction volume, on the one hand, and, on the other hand, especially the inherent weight of each earphone as well.

An earphone with microphone is also known from JP 07 131877 in which an elastically deformable fastening clip is formed directly onto the earphone housing.

In addition, a permanent magnetic closure consisting of two fastening parts which always work together is known from GB 2,186,625A. The always together working fastening parts are adapted to two different objects/construction parts so that these two objects/construction parts can be connected with each other by means of the permanent magnetic closure, as described above in the GB 2 186 625 A.

The invention is based on the problem of eliminating the drawbacks of the prior art described above, and in particular on the aim to develop a safe and optimal fastening system that can be handled in an easy way, exactly positioned and produced at favorable cost even when used for the types of construction of earphones and/or mini-microphones that have been manufactured for years, which will neither increase the transport weight nor the structural volume of the earphones and/or mini-microphones, and which, furthermore, with appropriate positioning on items of clothing and/or equipment, permits them to be used when fixed, and, moreover, assures safety against overload with an emergency release function when the cables of the earphones and/or mini-microphone are subjected to strong pulling (with the exception of special designs of their construction).

Said problem is solved according to the invention in that a permanent magnet (2), a magnetic system (6) or an adhesive system (1) is mounted in the site intended for fixing the earphones (9) and/or mini-microphones (16) outside of or on the inside of the respective item of clothing and/or item of equipment.

Surprisingly, just the functionally technically conditioned magnetic properties, which are inherent in any earphone and also mini-microphone, effect due to the low weight of the earphones and/or mini-microphones a safe, force-locked fastening of the earphones and/or mini-microphones with their feed cables on the respective item of clothing or item of equipment within the range of a permanent magnet mounted there according to the invention.

The benefits of such a device as defined by the invention for fixing earphones and/or mini-microphones on pieces of clothing and/or equipment are obvious, because in connection with this fastening solution as defined by the invention, it is not necessary to increase either the transport weight or the volume of the construction of the earphones and/or mini-microphones, or to increase the transport weight and/or the volume of the construction of the accessories required for transmitting the signals.

It is made possible for the first time by means of the device as defined by the invention to attach almost any type of construction of earphones and/or mini-microphones that is commercially available at the present time, at any time to the item of clothing and/or equipment equipped as defined by the invention, in a safe and optimal way at favorable cost, and to do so in such a way that such earphones and/or mini-microphones can be exactly positioned and handled in a simple way.

Furthermore, the fastening device as defined by the invention effects at the same time safety against overload with the help of an emergency release function when the earphone and/or mini-microphone is pulled hard, because the magnetic retaining forces of the holding device as defined by the invention can be overcome in the presence of extreme tensile and/or thrust stresses without entailing, for example if the cable is subjected to tensile stress, any destruction of the functional assemblies of the adapted earphone and/or mini-microphone as a result of such tensile stress.

Test series carried out by acknowledged institutes have shown as well that the type of fastening as defined by the invention has no bearing on the quality of the sound of the adapted earphones and/or mini-microphone, and that, for example a microphone adapted to the region of the chest as defined by the invention, or earphones secured as defined by the invention on the edge of a cap, can be used in the adapted condition in accordance with its purpose of application as well.

It is characteristic, furthermore, that one or more pole plates (5) can be arranged on the permanent magnet (2), such pole plates forming the magnetic system (6) jointly with the permanent magnet (2). Such Fe-pole plates consisting of, for example St 37 focus the broadly scattering magnet field of the permanent magnet with the focusing effect obtained with a burning glass, which entails a highly noticeable increase in the adhesive power for the earphones and/or mini-microphones on the fastening element as defined by the invention, so that permanent magnets with a weaker magnetic field can be employed as defined by the invention as well. Furthermore, the one or more pole plates (5) as defined by the invention effect at the same time a very substantial mechanical stabilization of the permanent magnet and thus a substantial increase in the bending strength of the latter. The one or more pole plates prevent mechanical overloading in the presence of mechanical bending or impact stress, so that the permanent magnets employed as defined by the invention will not be damaged, for example while the items of clothing are washed and centrifuged either.

Furthermore, it is essential to the invention that the permanent magnet (5) or the magnetic system (6) formed by the permanent magnet (2) and the one or more pole plates (5) is fused or cast in plastic and hermetically sealed in this way, forming an adhesive system in this way. This hermetically tight, plastic capsule effects an additional mechanical, but at the same time also a chemical stabilization of the permanent magnet, so that the latter will not be damaged or caused to corrode, for example by the mechanical and/or chemical influences it is exposed to while the items of clothing equipped as defined by the invention are washed.

It is characteristic, furthermore, that the plastic (3) of the adhesive system (1) may protrude beyond the magnetic system (6) or the permanent magnet (2) in the form of a fastening edge. Such a fastening edge, which preferentially has a wall thickness that is dimensioned weaker vis-à-vis the enveloped permanent magnet (2) or the enveloped magnetic system (6), permits the fastening plates to be sewn to the respective items of clothing and/or equipment externally or to the underside.

Furthermore, it is important that the permanent magnets (2), the magnetic systems (6) or the adhesive systems (1) are plugged into, sewn to/glued to, sewn into/glued into small pockets (13) of the respective item of clothing and/or equipment, or joined with the respective item of clothing and/or equipment in a detachable manner, for example by means of a closure that can be fastened to itself. In addition to the possibilities available for connecting the device as defined by the invention with the respective item of clothing and/or equipment in a non-detachable manner, the releasable connections are always suitable particularly if not all items of a series of clothing articles are to be equipped with the device as defined by the invention, on the one hand, or if, for example magnet plates and magnet system plates that are not jacketed, are used, on the other hand. Such magnet plates and magnetic system plates should be removed from the item of clothing during washing in order to avoid their destruction or phenomena of corrosion and the damage connected therewith.

Another important feature of the invention consists in that a locking hook (7) or a positioning element (8) for positioning the earphone (9) and/or the mini-microphone (16) can be molded onto an adhesive system (1). Mounting a positioning system (8) on the adhesive system (1) makes it more difficult for the adapted earphone and/or mini-microphone to slip off, but will nonetheless assure the emergency release function.

In connection with a special type of construction of the solution as defined by the invention, in which a locking hook (7) is arranged on the adhesive system (1), it is, of course, not possible to realize any overload protection, i.e. "emergency release function". Such types of construction are employed, for example in the field of fitness and leisure sport activities for safely securing the earphone on the item of clothing and/or equipment in a force-locked and, furthermore, form-locked manner as well. Such types of construction are suited even for extreme stresses as they occur, for example during aerobics exercises or when jogging.

Furthermore, it is characteristic that the permanent magnets (2), the magnetic systems (6) or the adhesive systems (1) are molded into the fabric of the item of clothing and/or equipment with plastic (3), for example with PU foam material, either alone or jointly with a positioning element (8) for positioning the earphone (9) or the mini-microphone.

This special embodiment of the solution as defined by the invention offers the advantage that the fastening site on the item of clothing and/or equipment as defined by the invention can be readily located, i.e. by feeling it in a simpler way. Another advantage of this embodiment consists in that no external element on the item of clothing and/or equipment has to be attached, so that the arrangement of the fastening elements as defined by the invention will not divert the attention from the design of the respective item of clothing and/or equipment. The "seamless" arrangement of the fastening elements as defined by the invention is highly advantageous especially when watertight fabric materials are processed such as, for example "GORE TEX".

Additional features, details and advantages of the invention can be derived in connection with the associated drawings, and are, furthermore, obvious from the exemplified embodiments and the explanations pertaining to the latter.

However, the possible forms of realization of the invention are not limited to the exemplified embodiments introduced in the following.

DETAILED DESCRIPTION OF PREFERRED EMBODIMENTS

Figure 1:
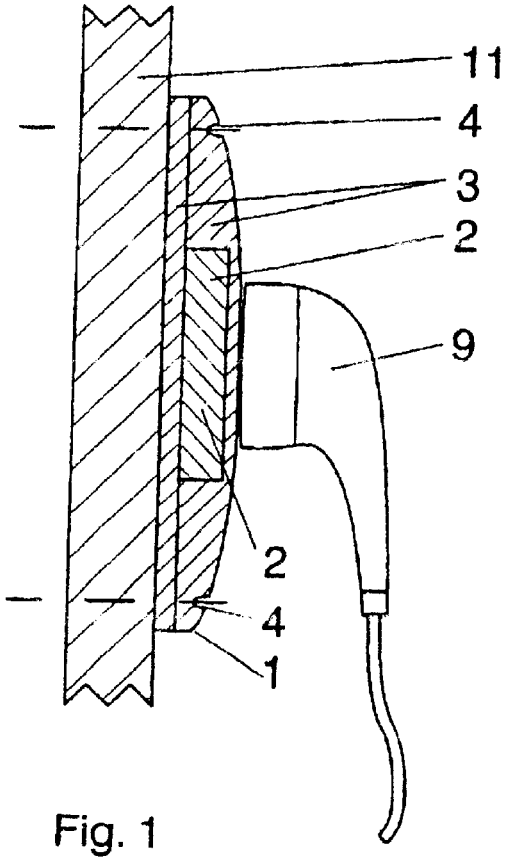
FIG. 1 shows a sectional view of a device for fastening earphones in accordance with an embodiment of the invention.

FIG. 1 shows a sectional view of an adhesive system 1 with the permanent magnet 2 cast in the plastic 3, and the earphone 9, which is attached to said adhesive system 1. The plastic 3 protrudes beyond the permanent magnet 2 on the outer circumference and is forming in this way the fastening edge 4 for securing the adhesive system 1, for example, on a collar 11. The permanent magnet 2 is fused or poured into the plastic 3 in a hermetically sealed manner and is forming the adhesive system 1 in this way. When the cable of the earphone and/or the mini-microphone is pulled very hard, the fastening device as defined by the invention effects at the same time overload protection and an emergency release function, because the magnetic retaining forces of the holding device as defined by the invention can be overcome in the presence of extreme tensile and/or thrust stresses without causing any destruction of the functional assemblies of the attached earphone and/or mini-microphone due to the tensile stress acting, for example to the cable.

The hermetically sealed plastic capsule, furthermore, effects an additional mechanical, but at the same time also chemical stabilization of the permanent magnet 2, so that the items of clothing and/or equipment outfitted as defined by the invention will not be damaged, for example by the mechanical and/or chemical influences (including, for example any phenomena of corrosion caused by the assemblies as defined by the invention) occurring during washing.

Figure 2:
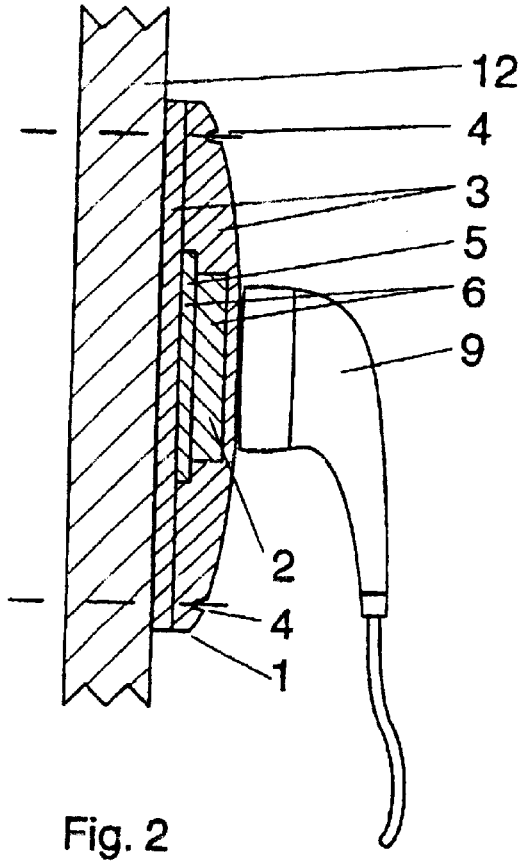
FIG. 2 is a sectional view of an adhesive system used in a device for fastening earphones in accordance with an embodiment of the invention.

FIG. 2 is a sectional view of an adhesive system 1 with a magnetic system 6 comprised of the pole plate 5 and the permanent magnet 2 and cast in plastic 3. An earphone 9 is again attached to the adhesive system 1.

The pole plate 5, which, for example consists of St 37 and is arranged below the permanent magnet 2, focuses the widely scattering magnetic field of the permanent magnet 2 with an effect comparable to the focusing effect of a magnifying glass. This results in a highly noticeable increase in the adhesive force of the magnetic systems 6 versus a single permanent magnet 2. According to the invention, this makes it possible to employ also permanent magnets 2 with a weaker magnetic field for adapting the earphones 9 or the mini-microphones 16 to the adhesive system 1 as defined by the invention. The arrangement of the one or more pole plates as defined by the invention effects in this connection at the same time a substantial mechanical stabilization of the permanent magnets 2, and in this way prevents damage in the presence of any bending or impact stress, so that the permanent magnets with weak walls employed as defined by the invention will not break, for example when the items of clothing are washed and centrifuged.

Figure 3:
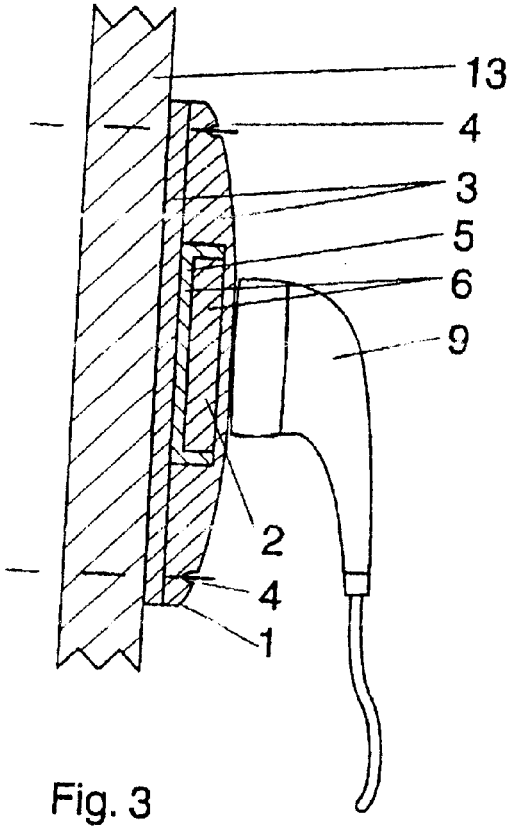
FIG. 3 shows an adhesive system similar to FIG. 2 with a pot-shape or U-shape pole plate.

FIG. 3 shows an adhesive system 1 structured analogous to FIG. 2 with the magnetic system 6 and the adapted earphone 9; however, with a pot-shaped or U-shaped pole plate 5 employed in the present embodiment.

Figure 4:
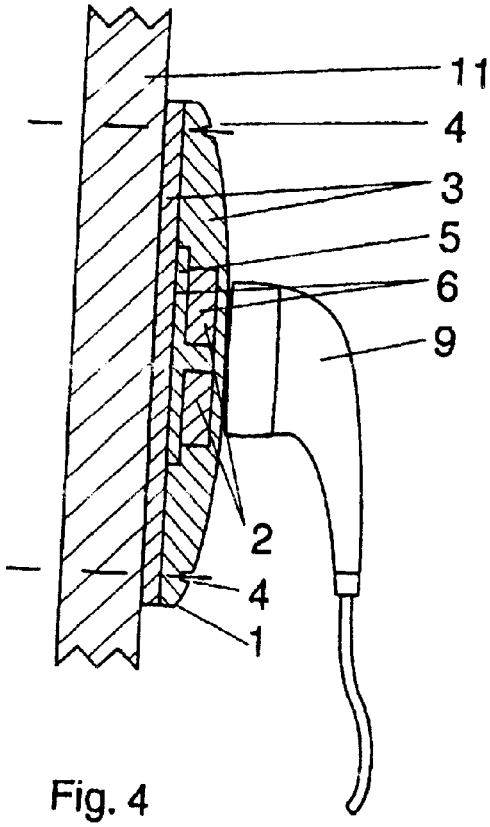
FIG. 4 shows an adhesive system similar to FIG. 2 in which the pole plate has a center pin over which a ring disk magnet is plugged.

FIG. 4 shows, again analogous to the representation according to FIG. 2, an adhesive system 1 with the integrated magnetic system 6. In the present embodiment, the pole plate 5 has a center pin over which a permanent magnet 2 in the form of a ring disk is plugged.

Figure 5:
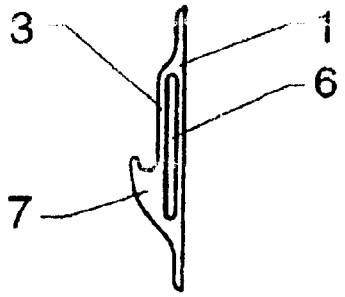
FIG. 5 shows a sectional side view of an adhesive system with an integrated locking hook used in a device for fastening earphones in accordance with an embodiment of the invention.
Figure 6:
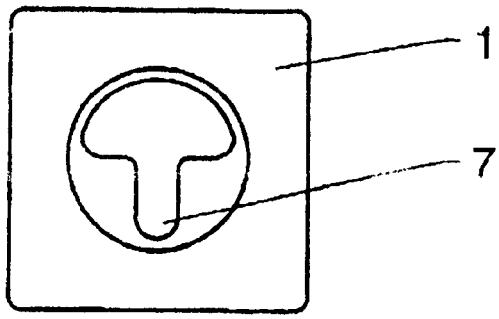
FIG. 6 is a front view of the adhesive system of FIG. 5.

FIGS. 5 and 6 show an adhesive system 1 with the integrated magnetic system 6 and the molded-on locking hooks 7 for the earphone and/or mini-microphone. In connection with this special type of construction of the solution as defined by the invention, where a locking hook 7 is arranged on the adhesive system 1, it is, of course, not possible to realize any overload protection, that is to say any "emergency release function". Such types of construction are used, for example in the area of fitness and leisure sports activities for the purpose of securing the earphones in a safely force-locked and, furthermore, form-locked manner on the item of clothing and/or equipment. Embodiments of this type are suited even for extreme stresses as they occur, for example in aerobatics and during jogging.

FIG. 5 shows in this connection the adhesive system 1 with the integrated locking hook 7 seen in a sectional side view.

FIG. 6 represents the front view of the adhesive system 1 belonging to FIG. 5, where the locking hook 7 is molded on.

Figure 7:
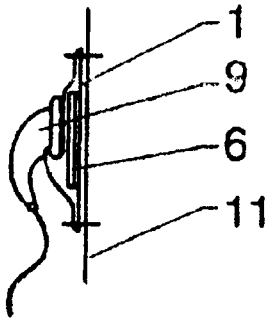
FIG. 7 is a sectional view of an adhesive system with an integrated locking hook sewn to a collar in accordance with an embodiment of the invention.

FIG. 7 shows a sectional view of the adhesive system 1 with the integrated locking hook 7 sewn to a collar 11, where the adhesive system 1 is provided with a permanent magnet 6 and the earphone 9 is arrested on said locking hook.

Figure 8:
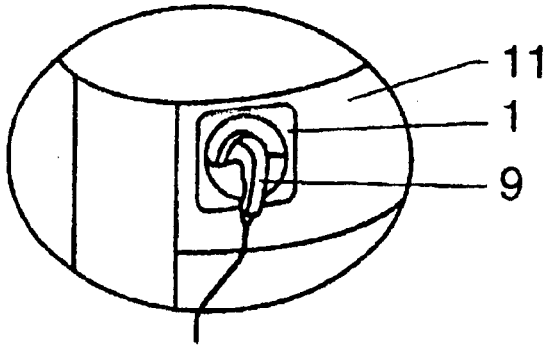
FIG. 8 is a front view of the adhesive system of FIG. 7.

FIG. 8 shows the front view of a special adhesive system 1 that is associated with FIG. 7, where the adhesive system is arranged on a collar and the earphone 9 is arrested.

Figure 9:
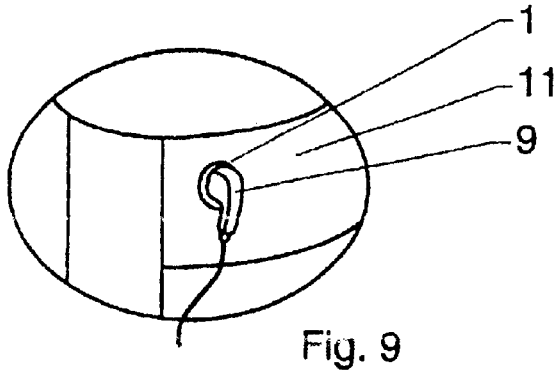
FIG. 9 shows an "invisible" variation of the fastening of an earphone in accordance with an embodiment of the invention.

The "invisible" variation of the fastening of the earphone 9 as defined by the invention of an adhesive system 1 arranged on a collar 11 is shown in FIG. 9. Advantageous in connection with this "invisible" variation is the arrangement of the magnetic system 6 as defined by the invention, in a manner such that the overall visual appearance of the collar 11 is not impaired by the arrangement of the device as defined by the invention.

Figure 10:
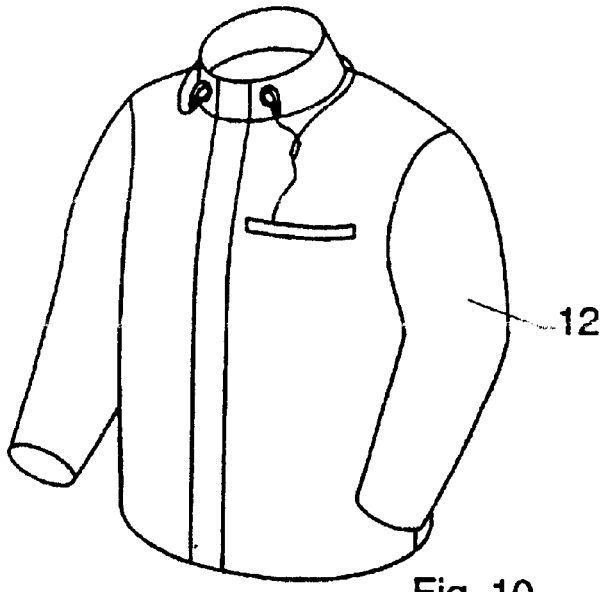
FIG. 10 shows a playback unit arranged in a breast pocket of a jacket in accordance with an embodiment of the invention.

The playback unit may be arranged in a breast pocket of a jacket 12 as shown in FIG. 10.

FIGS. 11 to 14 show, in section, a number of different possibilities available for arranging the fastening device as defined by the invention, for example a magnetic system 6, in an "invisible" way.

Figure 11:
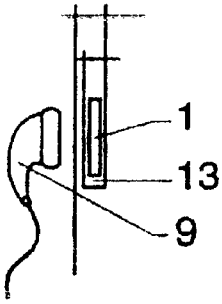
FIG. 11 shows an embodiment of the invention in which an adhesive system was sewn into a hidden pocket to secure the earphone.

According to FIG. 11, an adhesive system 1 was sewn into a hidden pocket 13 to secure the earphone 9 according to the invention.

Figure 12:
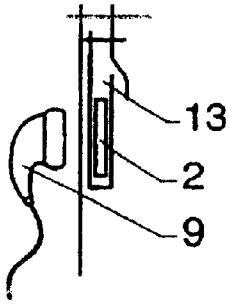
FIG. 12 shows an embodiment of the invention in which a permanent magnet was inserted in a hidden pocket to secure the earphone.

In FIG. 12, a permanent magnet 2 was inserted in a hidden pocket 13 to secure the earphone 9 according to the invention, so that the magnetic system 6 can be removed from the pocket 13, for example when the item of clothing needs to be washed.

Figure 13:
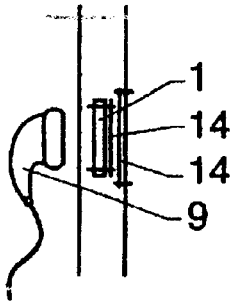
FIG. 13 shows an embodiment of the invention in which an adhesive system is sewn to closing material that can be fastened to itself.

Another possibility for arranging the device as defined by the invention in a detachable manner on the item of clothing and/or equipment is shown in FIG. 13. In the present case, an adhesive system 1 for securing the earphone 9 according to the invention is sewn to closing material that can be fastened to itself. The closing material 14 is sewn also to the inner fabric of the item of clothing and/or equipment, so that the aforementioned fastening plate can be fixed there to the latter.

Figure 14:
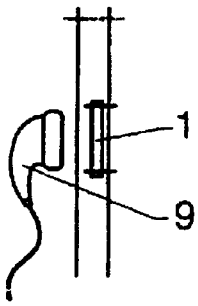
FIG. 14 shows an embodiment of the invention in which an adhesive system is sewn to the inner fabric of an item.

In FIG. 14, the adhesive system 1 for securing the earphone 9 is sewn to the inner fabric of the item of clothing and/or equipment as defined by the invention.

Figure 15:
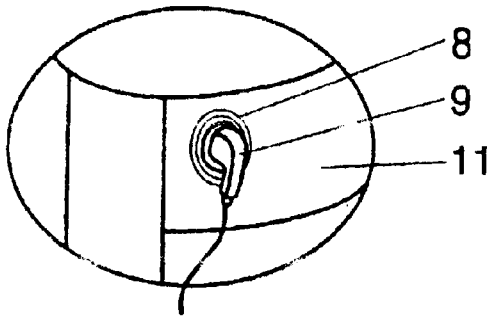
FIGS. 15–17 show embodiments of the invention in which the magnetic systems are molded and hermetically sealed into the fabric of clothing.
Figure 16:
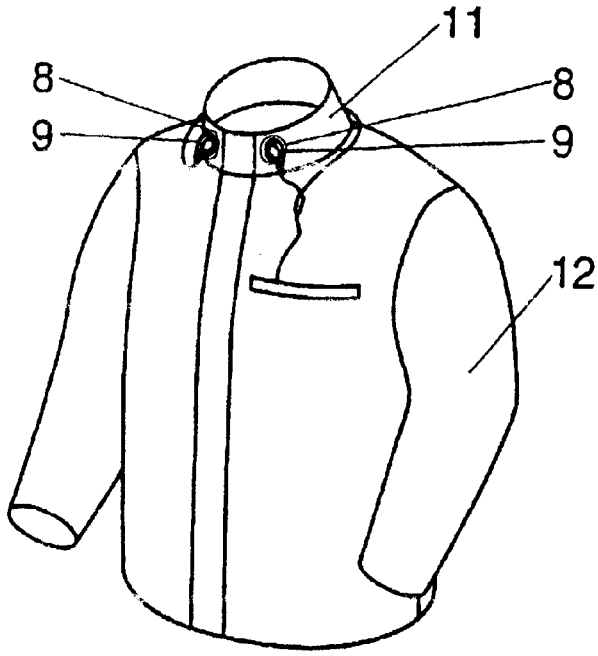
Figure 17:
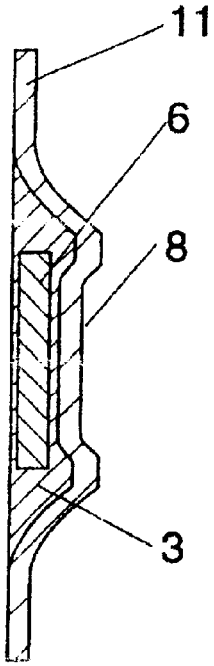

In the embodiments shown in FIGS. 15 to 17, in the site where the earphone 9 is to be secured, the magnetic systems 6 are molded and hermetically sealed with the use of the plastic 3, for example PU foam material, into the fabric of the item of clothing, which is the collar 11 of a jacket 12, together with a positioning element 8 for positioning the earphone 9.

This special embodiment of the solution as defined by the invention offers the advantage that it is possible to use magnetic systems 6 that are not enveloped with plastic material, but nonetheless can be cast with hermetic sealing when secured on the item of clothing and/or equipment, and at the same time reshaped with a fastening edge serving as the positioning element 8, so that the fastening area as defined by the invention can be easily located on the item of clothing and/or equipment, i.e. by simply feeling it. Another benefit of these special types of embodiment consists in that no external elements on the item of clothing and/or equipment has to be attached, so that the arrangement of the fastening elements as defined by the invention will not divert from the design of the item of clothing and/or equipment involved. Furthermore, the "seamless" arrangement is very advantageous when waterproof fabrics such as, for example "GORE TEX" are processed.

Figure 18:
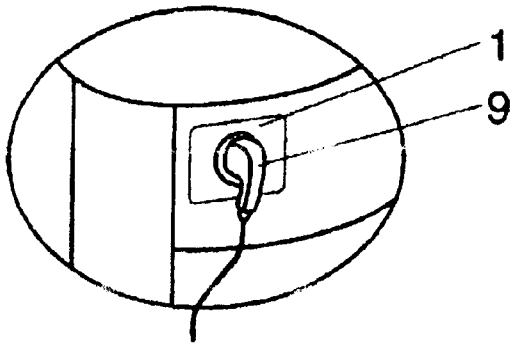
FIGS. 18 and 19 show embodiments of the invention in which the sites of fastening are visible.
Figure 19:
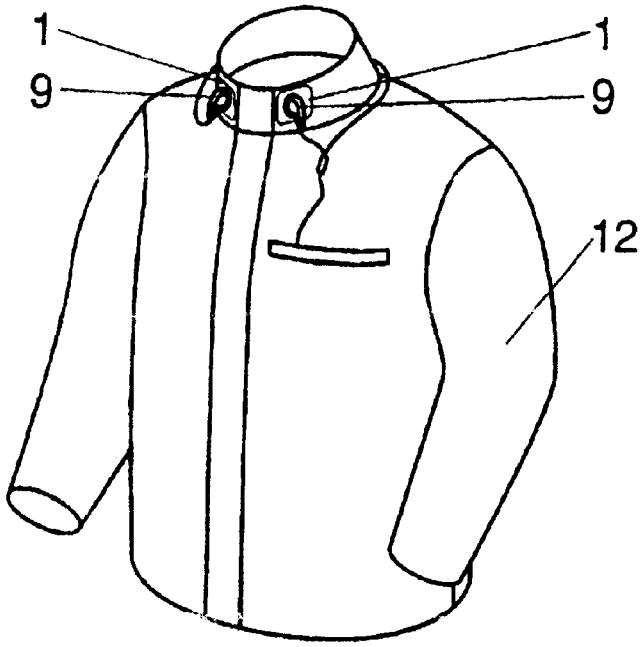

FIGS. 18 and 19 show adhesive systems 1, with the earphones 9 attached sewn to the collar of a jacket 12 clearly visible.

This intentionally visible arrangement of the sites of fastening is used to clearly point out that the solution as defined by the invention is integrated in the item of clothing or equipment.

Figure 20:
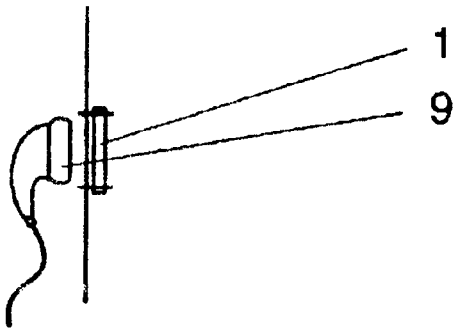
FIG. 20 shows an embodiment of the invention with a sewn-in adhesive system.

FIG. 20 shows a sewn-in adhesive system 1 with the earphones 9 that have to be adapted to this system. In this connection, the fastening seams for securing the adhesive system 1 can visually "underline" the solution as defined by the invention in a very pronounced manner as well, said solution being integrated in the item of clothing.

Now, FIGS. 21 to 26 illustrate different possibilities for implementing the solution as defined by the invention on items of clothing and/or equipment.

Figure 21:
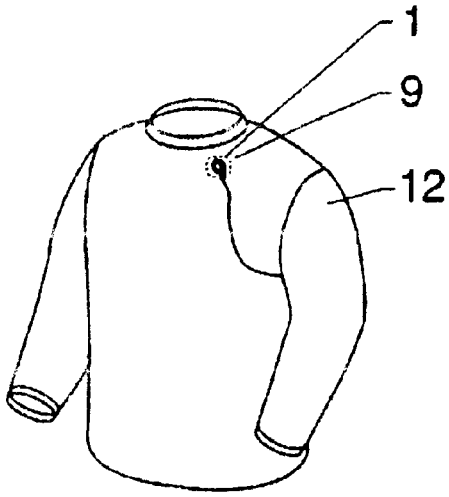
FIG. 21 shows a jacket with adhesive systems and adapted earphones stitched from behind.

FIG. 21 shows another jacket 12 with the adhesive systems 1 and the earphone 9 adapted to the latter sewn on from behind by means of stitching.

Figure 22:
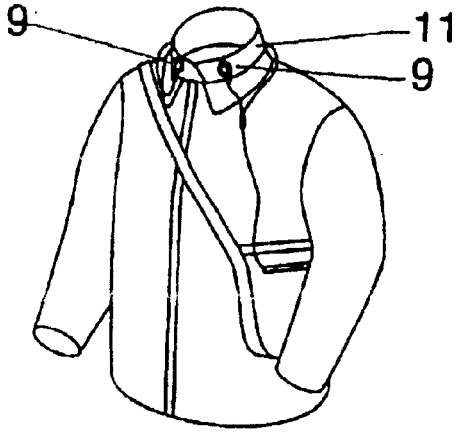
FIG. 22 shows an embodiment of the invention in which adhesive systems are "invisibly" arranged on a collar.

In FIG. 22, the adhesive systems 1 are "invisibly" arranged on a collar 11, and the earphones 9 are adapted to these adhesive systems.

Figure 23:
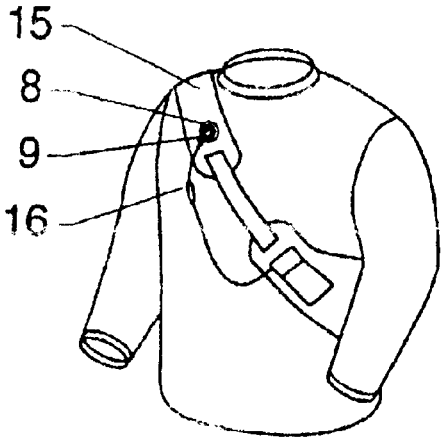
FIG. 23 shows an embodiment of the invention in which an adhesive system with a positioning element is arranged on a shoulder bag.

In FIG. 23, an adhesive system 1 with a positioning element 8 is arranged on a shoulder bag 15. An earphone 9 with the freely suspended mini-microphone 16 has been adapted to said adhesive system.

Figure 24:
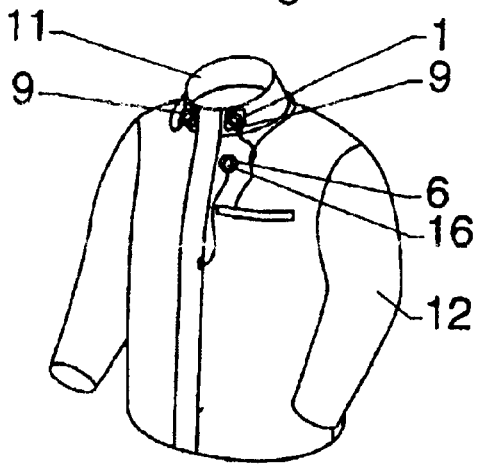
FIG. 24 shows an embodiment of the invention in which an earphone has a separate mini-microphone.

FIG. 24 shows the earphone 9 with a separate mini-microphone 16. In this connection, the separate mini-microphone 16 has been adapted as defined by the invention in the chest region as well. It has to be noted at this point that the mini-microphone adapted as defined by the invention can remain on the adhesive system 1 even when the user is speaking. The additional adhesive systems 1 are sewn to the collar on both sides, and the earphones 9 are adapted to said adhesive systems as defined by the invention.

Figure 25:
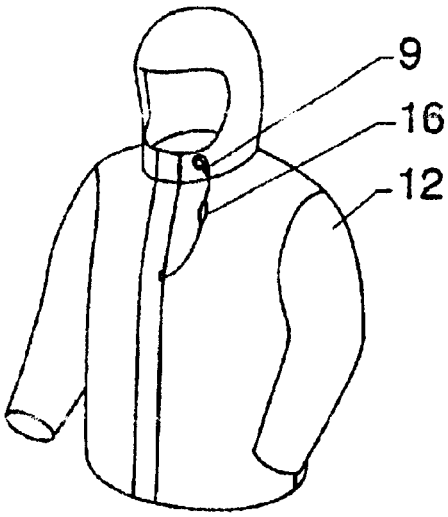
FIG. 25 shows an embodiment of the invention as implemented on the hood of a jacket.

FIG. 25 shows the implementation of the solution as defined by the invention on a head cover. In the present case, the adhesive system was arranged on the hood of a jacket 12. Here, an earphone 9, for example, is adapted as defined by the invention to the adhesive system arranged on the hood of the jacket 12. A freely suspended mini-microphone 16 is arranged on said adapted earphone 9.

Figure 26:
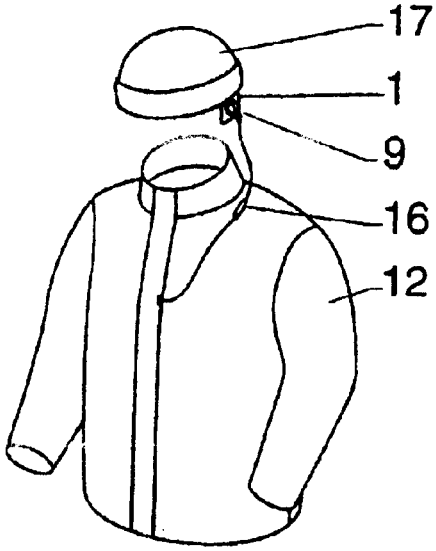
FIG. 26 shows an embodiment of the invention in which an adhesive system is arranged on a separate head cover.

Now, FIG. 26 shows an adhesive system 1 arranged on a separate head cover 17, with an earphone 9 adapted to said system, as well as with a freely suspended mini-microphone 16 connected to said earphone 9. With this embodiment, the basic device such as, for example a handy can be always used immediately and is accommodated, for example in an inside pocket of the jacket 12.

With the solution as defined by the invention, it was successfully possible to develop a secure and optimal fastening system that can be handled in a simple manner and exactly positioned even in connection with the types of construction of earphones and/or mini-microphones that have been manufactured for years. Said fastening system, furthermore, will neither increase the transport weight nor the construction volume of the earphones and/or mini-microphones, and, furthermore, with suitable positioning on the item of clothing and/or equipment, can be used even in the adapted condition. Furthermore, it assures protection against overload with an emergency release function when the cables for the earphones and mini-microphones are pulled hard (with the exception of the special types of construction comprising a locking hook 7).

List of Reverence Numerals

1 Adhesive system
2 Permanent magnet
3 Plastic
4 Fastening edge
5 Pole plate
6 Magnetic system
7 Locking hook
8 Positioning element
9 Earphone
10 Cable
11 Collar
12 Jacket
13 Pocket
14 Closure material
15 Shoulder bag
16 Mini-microphone
17 Head garment

What is claimed is:

1. A method of using a permanent magnet to attach an earphone or a small microphone to an article of clothing or equipment comprising the steps of:

(a) selecting a planned attachment point for the earphone or the small microphone outside of or within the article of clothing or equipment;

(b) arranging a permanent magnet on the planned attachment point; and (c) attaching the earphone or the small microphone to the attachment point using only magnetic properties inherent only in the earphone or small microphone in combination with the Permanent magnet.

2. The method according to claim 1 wherein one or more pole plates are arranged on the permanent magnet to form with the permanent magnet a magnetic system.

3. The method according to claim 1 wherein the permanent magnet is bonded or cast in plastic and hermetically sealed to form an adhesion system.

4. The method according to claim 2 wherein the magnetic system is bonded or cast in plastic and hermetically sealed to form an adhesion system.

5. The method according to claim 3 wherein the plastic of the adhesion system projects beyond the permanent magnet in the form of an attachment border.

6. The method according to claim 4 wherein the plastic of the adhesion system projects beyond the magnetic system in the form of an attachment border.

7. The method according to claim 1 wherein the permanent magnet is inserted into, sewn onto, glued onto, sewn into or glued into a small pocket of the article of clothing or equipment, or releasably connected with the article of clothing or equipment.

8. The method according to claim 2 wherein the magnetic system is inserted into, sewn onto, glued onto, sewn into or glued into a small pocket of the article of clothing or equipment, or releasably connected with the article of clothing or equipment.

9. The method according to claim 3 wherein the adhesion system is inserted into, sewn onto, glued onto, sewn into or glued into, a small pocket of the article of clothing or equipment, or releasably connected with the article of clothing or equipment.

10. The method according to claim 3 wherein a catch hook or a positioning element for the earphone or the small microphone is formed on the adhesion system.

11. The method according to claim 1 wherein the article of clothing or equipment includes fabric, and on the article of clothing or equipment, in the planned attachment region for the earphone or the small microphone, the permanent magnet by itself or together with a positioning element for the earphone or the small microphone, is formed into the fabric of the article of clothing or equipment, using plastic.

12. The method according to claim 11 wherein the plastic comprises polyurethane foam.

13. The method according to claim 2 wherein the article of clothing or equipment includes fabric, and on the article of clothing or equipment, in the planned attachment region for the earphone or the small microphone, the magnetic system by itself or together with a positioning element for the earphone or the small microphone, is formed into the fabric of the article of clothing or equipment, using plastic.

14. The method according to claim 13 wherein the plastic comprises polyurethane foam.

15. The method according to claim 3 wherein the article of clothing or equipment includes fabric, and on the article of clothing or equipment, in the planned attachment region for the earphone or the small microphone, the adhesion system by itself or together with a positioning element for the earphone or the small microphone, is formed into the fabric of the article of clothing or equipment, using plastic.

16. The method according to claim 15 wherein the plastic comprises polyurethane foam.

* * * * *

UNITED STATES PATENT AND TRADEMARK OFFICE

CERTIFICATE OF CORRECTION

PATENT NO. : 7,013,492 B2
APPLICATION NO. : 10/204513
DATED : March 21, 2006
INVENTOR(S) : Hugh et al.

It is certified that error appears in the above-identified patent and that said Letters Patent is hereby corrected as shown below:

Col. 9, line 31, (Line 4 of subparagraph ( c)), please change "Permanent" to correctly read: --permanent--.

Signed and Sealed this

Eighth Day of August, 2006

JON W. DUDAS
*Director of the United States Patent and Trademark Office*